US011231665B2

(12) United States Patent
Nishiyama et al.

(10) Patent No.: US 11,231,665 B2
(45) Date of Patent: Jan. 25, 2022

(54) TONER CARTRIDGE INCLUDING DETECTION GEAR, AGITATOR GEAR, AUGER GEAR, AND TONER OUTLET

(71) Applicant: BROTHER KOGYO KABUSHIKI KAISHA, Nagoya (JP)

(72) Inventors: Hideshi Nishiyama, Owariasahi (JP); Naoya Kamimura, Ichinomiya (JP); Tomonori Watanabe, Ichinomiya (JP); Yasuo Fukamachi, Nagoya (JP); Shinya Kusuda, Nagoya (JP); Tomoya Yamamoto, Kasugai (JP)

(73) Assignee: BROTHER KOGYO KABUSHIKI KAISHA, Nagoya (JP)

( * ) Notice: Subject to any disclaimer, the term of this patent is extended or adjusted under 35 U.S.C. 154(b) by 0 days.

(21) Appl. No.: 16/827,832

(22) Filed: Mar. 24, 2020

(65) Prior Publication Data

US 2020/0225604 A1 Jul. 16, 2020

Related U.S. Application Data

(63) Continuation of application No. 16/427,570, filed on May 31, 2019, now Pat. No. 10,642,190, which is a (Continued)

(30) Foreign Application Priority Data

Sep. 30, 2016 (JP) ..... 2016-194661

(51) Int. Cl.
*G03G 15/08* (2006.01)

(52) U.S. Cl.
CPC ..... *G03G 15/0889* (2013.01)

(58) Field of Classification Search
USPC ..... 399/263
See application file for complete search history.

(56) References Cited

U.S. PATENT DOCUMENTS 4,963,938 A * 10/1990 Sonoda ..... G03G 15/0856 399/106
2006/0193644 A1 8/2006 Takagi
(Continued)

FOREIGN PATENT DOCUMENTS

CN 201145823 Y 11/2008
CN 201532532 U 7/2010
(Continued)

OTHER PUBLICATIONS

Notification of Second Office Action issued in corresponding Chinese Patent Application No. 201710395735.2, dated Jun. 18, 2020.
(Continued)

*Primary Examiner* — Q Grainger
(74) *Attorney, Agent, or Firm* — Merchant & Gould P.C.

(57) ABSTRACT

A toner cartridge includes a casing, an auger rotatable about an axis extending in a first direction, an auger gear rotatable with the auger, an agitator aligned with the auger in a second direction, an agitator gear rotatable with the agitator, and a detection gear positioned opposite to the auger gear with respect to the agitator gear in the second direction. The detection gear is rotatable from a first position to a second position. At the first position, a through-hole or a cutout of the detection gear is positioned farther away from the auger than an outer surface of another end portion of the casing in the second direction is. At the second position, a portion of the detection gear different from the through-hole or the cutout is positioned farther away from the auger than the outer surface of the another end portion of the casing is.

20 Claims, 11 Drawing Sheets

Related U.S. Application Data continuation of application No. 15/471,968, filed on Mar. 28, 2017, now Pat. No. 10,338,499.

(56) References Cited

U.S. PATENT DOCUMENTS

| | | | | |
|---|---|---|---|---|
| 2007/0269225 | A1 | 11/2007 | Sato | |
| 2007/0269235 | A1* | 11/2007 | Hirose | G03G 15/0893 399/254 |
| 2010/0142993 | A1* | 6/2010 | Shiraki | G03G 21/1857 399/111 |
| 2011/0243578 | A1 | 10/2011 | Ukai et al. | |
| 2012/0114391 | A1 | 5/2012 | Horii | |
| 2013/0051814 | A1 | 2/2013 | Itabashi et al. | |
| 2013/0266347 | A1* | 10/2013 | Kubota | G03G 15/0896 399/262 |
| 2014/0186058 | A1 | 7/2014 | Shimizu | |
| 2015/0086222 | A1 | 3/2015 | Shimizu | |
| 2015/0117906 | A1 | 4/2015 | Mori | |
| 2015/0346632 | A1 | 12/2015 | Carpenter et al. | |
| 2017/0097588 | A1 | 4/2017 | Fukamachi et al. | |
| 2017/0131659 | A1 | 5/2017 | Sato | |
| 2018/0095382 | A1 | 4/2018 | Nishiyama et al. | |

FOREIGN PATENT DOCUMENTS

| | | | |
|---|---|---|---|
| CN | 104471490 | A | 3/2015 |
| CN | 104749926 | A | 7/2015 |
| CN | 205067967 | U | 3/2016 |
| CN | 206906797 | U | 1/2018 |
| JP | 7-160173 | A | 6/1995 |
| JP | 9-319284 | A | 12/1997 |
| JP | 2000-81814 | A | 3/2000 |
| JP | 2006-243073 | A | 9/2006 |
| JP | 2007-310146 | A | 11/2007 |
| JP | 2012-108537 | A | 6/2012 |
| JP | 2014-16498 | A | 1/2014 |
| JP | 2014-92613 | A | 5/2014 |
| JP | 2014-197146 | A | 10/2014 |
| JP | 2016-145906 | A | 8/2016 |

OTHER PUBLICATIONS

Notification of First Office Action issued in corresponding Chinese Patent Application No. 201710395735.2, dated Feb. 3, 2020.

Office Action (Notice of Reasons for Refusal) issued in corresponding Japanese Patent Application No. 2016-194661, dated Aug. 4, 2020.

Office Action issued in corresponding Japanese Patent Application No. 2020-187984, dated Oct. 19, 2021.

* cited by examiner

TONER CARTRIDGE INCLUDING DETECTION GEAR, AGITATOR GEAR, AUGER GEAR, AND TONER OUTLET

CROSS REFERENCE TO RELATED APPLICATION

This application is a continuation of application Ser. No. 16/427,570, filed May 31, 2019, which is continuation of application Ser. No. 15/471,968, filed Mar. 28, 2017, which further claims priority from Japanese Patent Application No. 2016-194661 filed Sep. 30, 2016. The entire contents of the aforementioned applications are incorporated herein by reference.

TECHNICAL FIELD

The present disclosure relates to a toner cartridge.

BACKGROUND

A toner cartridge including a casing for storing toner and a detection gear is well known in the art. In a state where the toner cartridge is attached to an image-forming apparatus, the detection gear is configured to rotate from a first position to a second position. In a state where the detection gear is rotated to the second position from the first position, the detection gear is positioned between a light-emitting element of the image-forming apparatus and a light-receiving element of the image-forming apparatus so that the detection gear can block light emitted from the light-emitting element. The light-emitting element and the light-receiving element may be both disposed near one end of the casing of the toner cartridge in a state where the toner cartridge is attached to the image-forming apparatus.

SUMMARY

In view of the foregoing, it is an object of the present disclosure to provide a toner cartridge that allows movement of a detection gear to be detected through a light-emitting element of an image-forming apparatus and a light-receiving element of the image-forming apparatus, even when a casing of the toner cartridge is positioned between the light-emitting element and the light-receiving element in a state where the toner cartridge is attached to the image-forming apparatus.

In order to attain the above and other objects, there is provided a toner cartridge including a casing, an auger, an auger gear, an agitator, an agitator gear, and a detection gear. The casing is configured to accommodate toner therein. The auger is rotatable about a first axis extending in a first direction and is configured to convey the toner in the first direction. The auger is positioned at one end portion of the casing in a second direction. The auger gear is provided at one end of the auger in the first direction. The auger gear is rotatable with the auger. The agitator is rotatable about a second axis extending in the first direction. The agitator is configured to agitate the toner and is configured to convey the toner toward the auger. The agitator is aligned with the auger in the second direction. The agitator gear is provided at one end of the agitator in the first direction and is rotatable with the agitator. The detection gear is positioned opposite to the auger gear with respect to the agitator gear in the second direction. The detection gear is rotatable from a first position to a second position. The detection gear includes one of a through-hole and a cutout. In a case where the detection gear is at the first position, the one of the through-hole and the cutout of the detection gear is positioned farther away from the auger than an outer surface of another end portion of the casing in the second direction is from the auger in the second direction. In a case where the detection gear is at the second position, an outer surface of a portion of the detection gear different from the one of the through-hole and the cutout is positioned farther away from the auger than the outer surface of the another end portion of the casing in the second direction is from the auger in the second direction.

According to another aspect, there is provided a toner cartridge including a casing, an auger, an auger gear, an agitator, an agitator gear, and a detection gear. The casing is configured to accommodate toner therein. The auger is rotatable about a first axis extending in a first direction and is configured to convey the toner in the first direction. The auger is positioned at one end portion of the casing in a second direction. The auger gear is positioned at one end of the auger in the first direction and is rotatable with the auger. The agitator is rotatable about a second axis extending in the first direction. The agitator is configured to agitate the toner and configured to convey the toner toward the auger. The agitator is aligned with the auger in the second direction. The agitator gear is positioned at one end of the agitator in the first direction and is rotatable with the agitator. The detection gear is positioned opposite to the auger gear with respect to the agitator gear in the second direction. The detection gear is rotatable from a first position to a second position. The detection gear includes a light-transmission portion and a light-blocking portion. In a case where the detection gear is at the first position, the light-transmission portion of the detection gear is positioned farther away from the auger than an outer surface of another end portion of the casing in the second direction is from the auger in the second direction. In a case where the detection gear is at the second position, the light-blocking portion of the detection gear is positioned farther away from the auger than the outer surface of the another end portion of the casing in the second direction is from the auger in the second direction.

DETAILED DESCRIPTION

Hereinafter, a toner cartridge 1 according to an embodiment of the disclosure will be described with reference to FIGS. 1 through 9.

1. Overview of the Toner Cartridge 1

Figure 1:
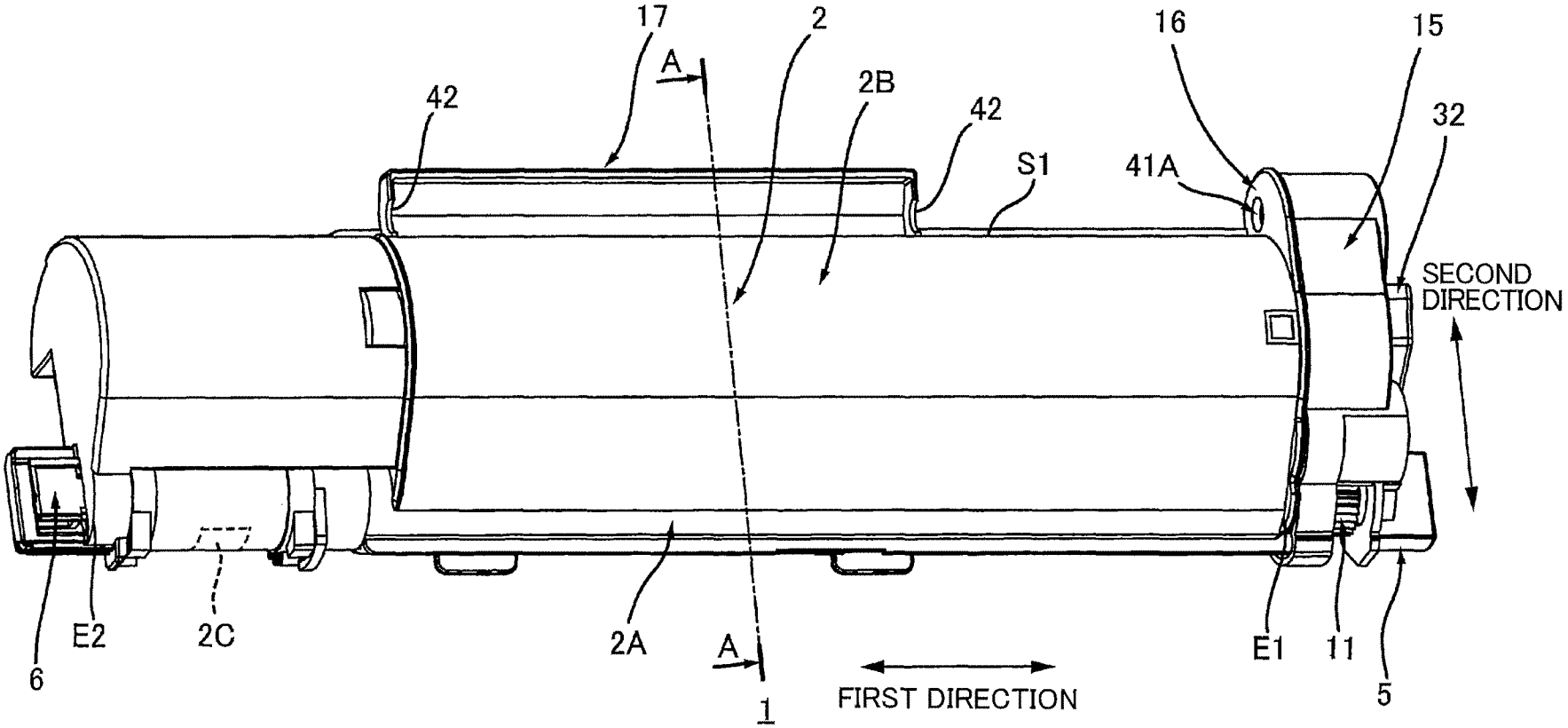
FIG. 1 is a perspective view of a toner cartridge according to an embodiment.
Figure 2:
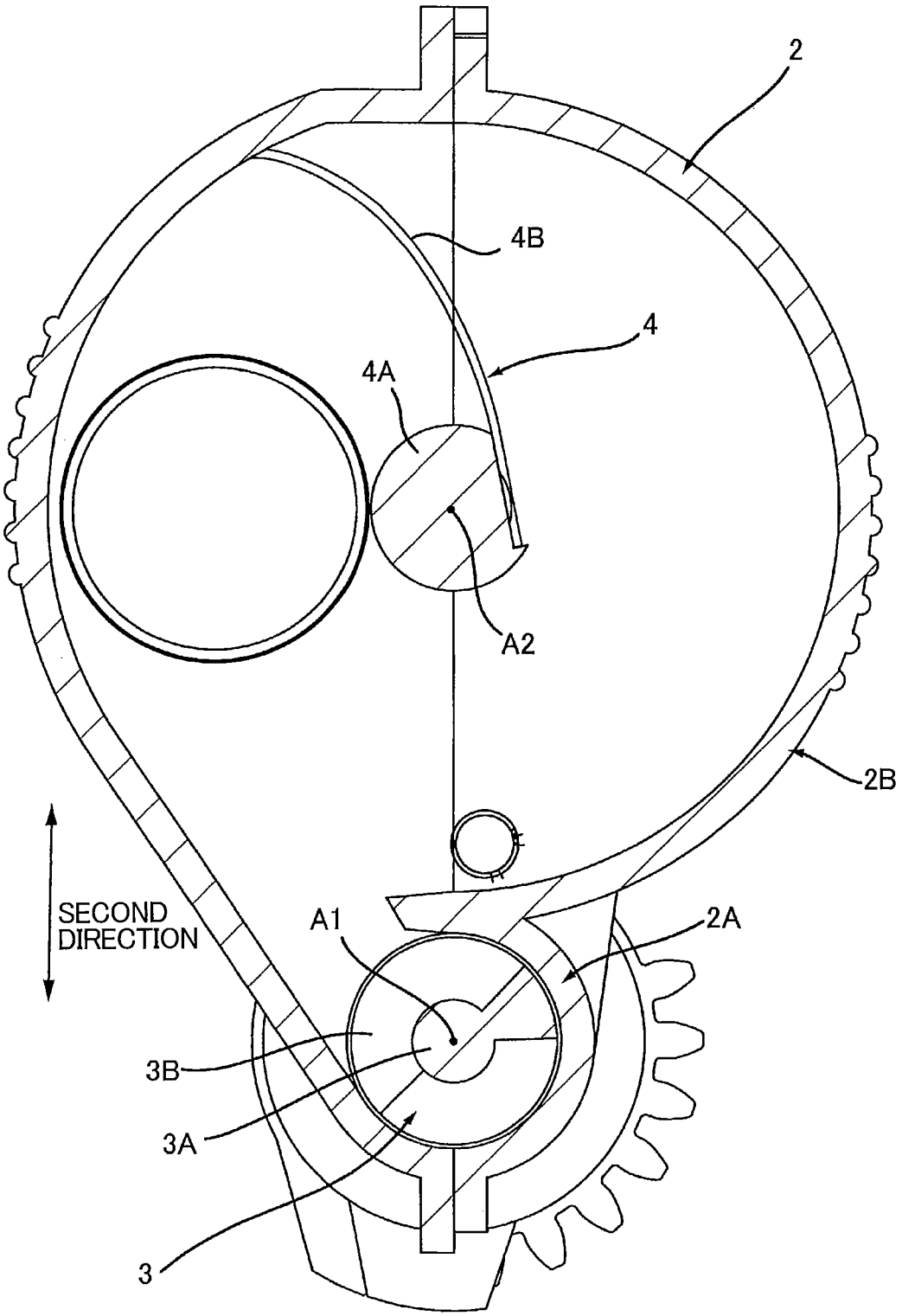
FIG. 2 is a cross-sectional view of the toner cartridge according to the embodiment taken along a plane A-A shown in FIG. 1.
Figure 3:
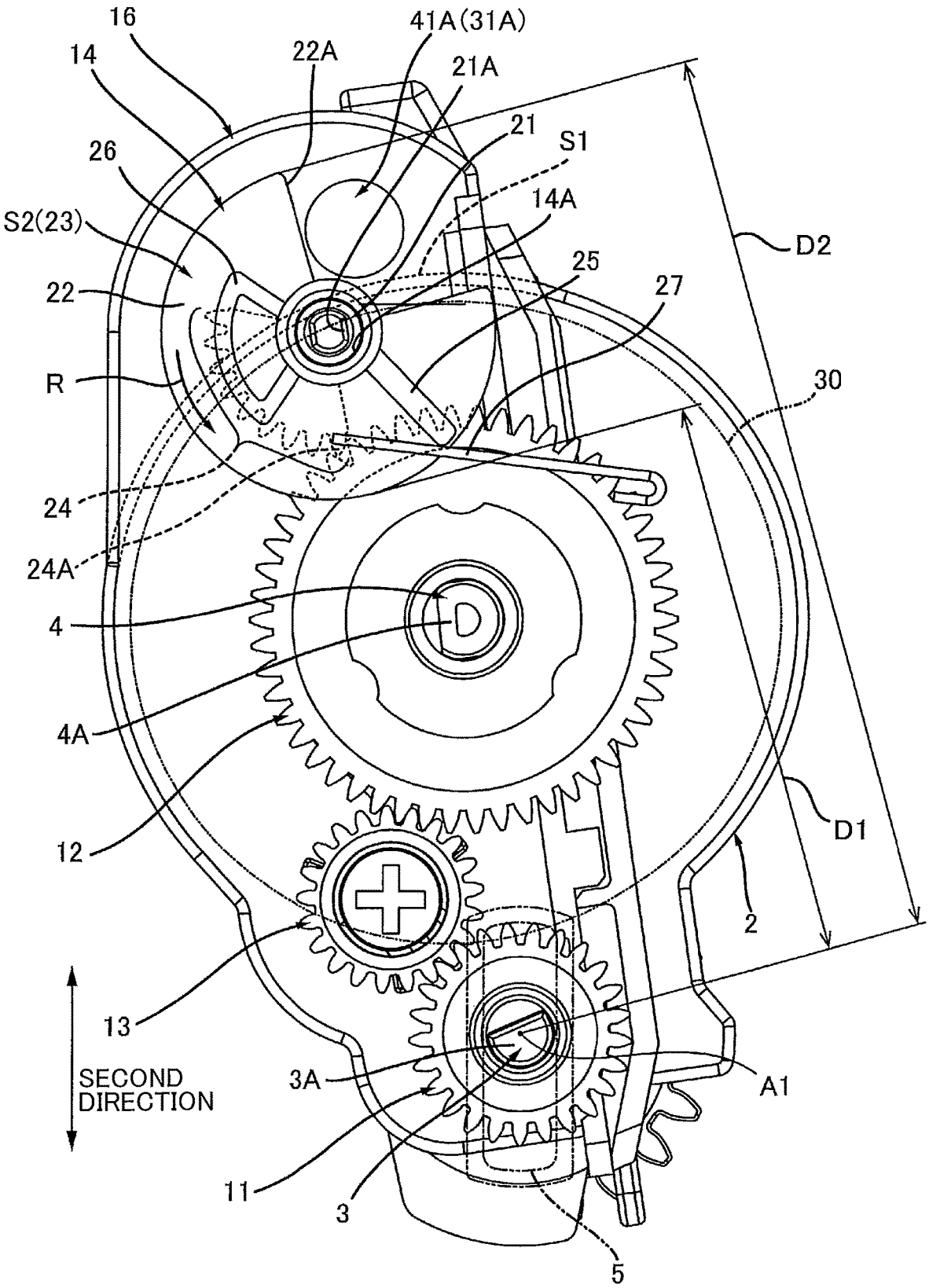
FIG. 3 is a side view of the toner cartridge according to the embodiment without a gear cover in a case where a detection gear is at a first position.

As shown in FIGS. 1 to 3, the toner cartridge 1 includes a casing 2, an auger 3, an agitator 4, a first protrusion 5, a second protrusion 6, an auger gear 11, an agitator gear 12, an idle gear 13, a detection gear 14, a gear cover 15, a frame 16, and a handle 17.

1.1 Casing 2

The casing 2 is configured to accommodate toner therein. As shown in FIG. 1, the casing 2 extends in a first direction. The casing 2 has a first end portion E1 and a second end portion E2 in the first direction. The second end portion E2 is spaced apart from the first end portion E1 in the first direction. The casing 2 has a first accommodation portion 2A and a second accommodation portion 2B.

The first accommodation portion 2A extends in the first direction. The first accommodation portion 2A has a hollow cylindrical shape and has a generally circular-shaped cross-section, as shown in FIG. 2. The first accommodation portion 2A is configured to accommodate toner therein. The second accommodation portion 2B extends in the first direction. The second accommodation portion 2B has a hollow cylindrical shape and has a generally circular-shaped cross-section, as shown in FIG. 2. The second accommodation portion 2B is configured to accommodate toner therein. The second accommodation portion 2B has an outer diameter that is larger than an outer diameter of the first accommodation portion 2A. The second accommodation portion 2B is aligned with the first accommodation portion 2A in a second direction, as shown in FIG. 2. That is, the second direction is defined as a direction in which and the first accommodation portion 2A are aligned with each other. Put another way, the second direction is also defined as a direction connecting a first axis A1 of the auger 3 and a second axis A2 of the agitator 4 (both described later). The second accommodation portion 2B is positioned adjacent to the first accommodation portion 2A in the second direction. The first accommodation portion 2A is in communication with the second accommodation portion 2B.

As shown in FIG. 1, the casing 2 includes a toner outlet 2C. The toner outlet 2C is a through-hole configured to allow the toner in the first accommodation portion 2A to be discharged. The toner outlet 2C is positioned at the second end portion E2 of the casing 2 in the first direction. The toner outlet 2C is aligned with the first accommodation portion 2A in the first direction. Specifically, the toner outlet 2C is positioned opposite to the auger gear 11 with respect to the first accommodation portion 2A in the first direction.

1.2 Auger 3

As shown in FIG. 2, the auger 3 is accommodated in the first accommodation portion 2A. Specifically, the auger 3 extends in the first direction. The auger 3 is rotatable about the first axis A1 extending in the first direction. The auger 3 is configured to convey the toner in the first accommodation portion 2A in the first direction to the toner outlet 2C. In the second direction, the auger 3 is positioned at one end portion of the casing 2.

Specifically, the auger 3 includes an auger shaft 3A and a helical portion 3B. The auger shaft 3A defines the first axis A1 and extends along the first axis A1 in the first direction. The auger shaft 3A has one end (see FIG. 3) in the first direction. The one end of the auger shaft 3A is positioned outside the casing 2. That is, the auger 3 has one end in the first direction that is positioned outside the casing 2. The helical portion 3B has a helical shape. The helical portion 3B is positioned at an outer surface of the auger shaft 3A in a helical manner. The helical portion 3B extends radially outward from the auger shaft 3A in the first accommodation portion 2A. In other words, the helical portion 3B extends in a radial direction of the first accommodation portion 2A. The helical portion 3B is thus rotatable with the auger shaft 3A. The helical portion 3B is positioned inside the casing 2. Specifically, the helical portion 3B is positioned in the first accommodation portion 2A. The helical portion 3B is configured to convey the toner within the first accommodation portion 2A in the first direction while the auger 3 (auger shaft 3A) rotates.

1.3 Agitator 4

Referring to FIG. 2, the agitator 4 is accommodated in the second accommodation portion 2B. The agitator 4 is rotatable about the second axis A2 that extends in the first direction. The agitator 4 and the auger 3 are aligned with each other in the second direction. The agitator 4 is configured to agitate and convey toner toward the auger 3. Specifically, the agitator 4 is configured to agitate and convey the toner in the second accommodation portion 2B toward the first accommodation portion 2A.

Specifically, the agitator 4 includes an agitator shaft 4A and a main portion 4B. The agitator shaft 4A defines the second axis A2 and extends along the second axis A2 in the first direction. The agitator shaft 4A has one end in the first direction. The one end of the agitator shaft 4A is positioned outside the casing 2. In other words, the agitator 4 has one end in the first direction that is positioned outside the casing 2. The main portion 4B is positioned at an outer surface of the agitator shaft 4A. The main portion 4B extends radially outward from the outer surface of the agitator shaft 4A. That is, the main portion 4B extends in a radial direction of the second accommodation portion 2B. The main portion 4B is thus rotatable with the agitator shaft 4A. The main portion 4B is positioned inside the casing 2. More specifically, the main portion 4B is positioned in the second accommodation portion 2B. The main portion 4B is configured to convey the toner in the second accommodation portion 2B in the second direction toward the auger 3 while the agitator 4 rotates.

1.4 First Protrusion 5 and Second Protrusion 6

As shown in FIG. 1, the first protrusion 5 is positioned at the first end portion E1 of the casing 2 in the first direction. Specifically, the first protrusion 5 is positioned at an outer surface of the gear cover 15 and extends from the gear cover 15 outward in the first direction. By the gear cover 15 being attached to the first end portion E1, the first protrusion 5 is positioned at the first end portion E1 of the casing 2. The first protrusion 5 is positioned opposite to the toner outlet 2C with respect to the first accommodation portion 2A in the first direction. The first protrusion 5 extends also in the second direction.

The second protrusion 6 is positioned at the second end portion E2 of the casing 2 in the first direction. The second protrusion 6 is positioned opposite to the auger gear 11 with respect to the casing 2 in the first direction. More specifically, the second protrusion 6 is positioned opposite to the first accommodation portion 2A with respect to the toner outlet 2C in the first direction. The second protrusion 6 extends in the first direction as well as in the second direction.

1.5 Auger gear 11

As shown in FIG. 3, the auger gear 11 is fixed to the one end of the auger 3 in the first direction that is positioned outside of the casing 2 to be exposed therefrom. Specifically, the auger gear 11 is mounted on the one end of the auger shaft 3A in the first direction that is exposed outside from the casing 2. The auger gear 11 is positioned at the first end portion E1 of the casing 2 in the first direction. The auger gear 11 is rotatable with the auger 3.

1.6 Agitator Gear 12

The agitator gear 12 is fixed to the one end of the agitator 4 in the first direction that is positioned outside of the casing 2 to be exposed therefrom. Specifically, the agitator gear 12 is fixed to the one end of the agitator shaft 4A in the first direction that is exposed outside from the casing 2. The agitator gear 12 is positioned at the first end portion E1 of the casing 2 in the first direction. The agitator gear 12 is thus rotatable with the agitator 4. Referring to FIG. 3, the agitator gear 12 is spaced apart from the auger gear 11 in the second direction. The agitator gear 12 has a diameter that is larger than a diameter of the auger gear 11. The diameter of the agitator gear 12 is also larger than a diameter of the idle gear 13 described next. The agitator 4 is thus rotatable at a rotational speed that is lower than a rotational speed of the auger 3.

1.7 Idle Gear 13

The idle gear 13 is positioned at the first end portion E1 of the casing 2 in the first direction. More specifically, the idle gear 13 is rotatably attached to the first end portion E1 of the casing 2 in the first direction. The idle gear 13 is rotatable relative to the casing 2. As shown in FIG. 2, the idle gear 13 is positioned between the agitator gear 12 and the auger gear 11 in the second direction. The idle gear 13 is positioned opposite to the detection gear 14 (described next) with respect to the agitator gear 12 in the second direction. The idle gear 13 meshes with the auger gear 11 and the agitator gear 12. The auger gear 11 is thus configured to transmit a driving force to the agitator gear 12 via the idle gear 13. The agitator gear 12 is rotatable upon receipt of the driving force from the auger gear 11 in accordance with rotation of the auger gear 11.

1.8 Detection Gear 14

In a state where the toner cartridge 1 is attached to an image-forming apparatus 120 described later (see FIG. 8), the image-forming apparatus 120 is configured to detect a rotational position of the detection gear 14, based on which the image-forming apparatus 120 is configured to detect information on the toner cartridge 1.

Figure 4:
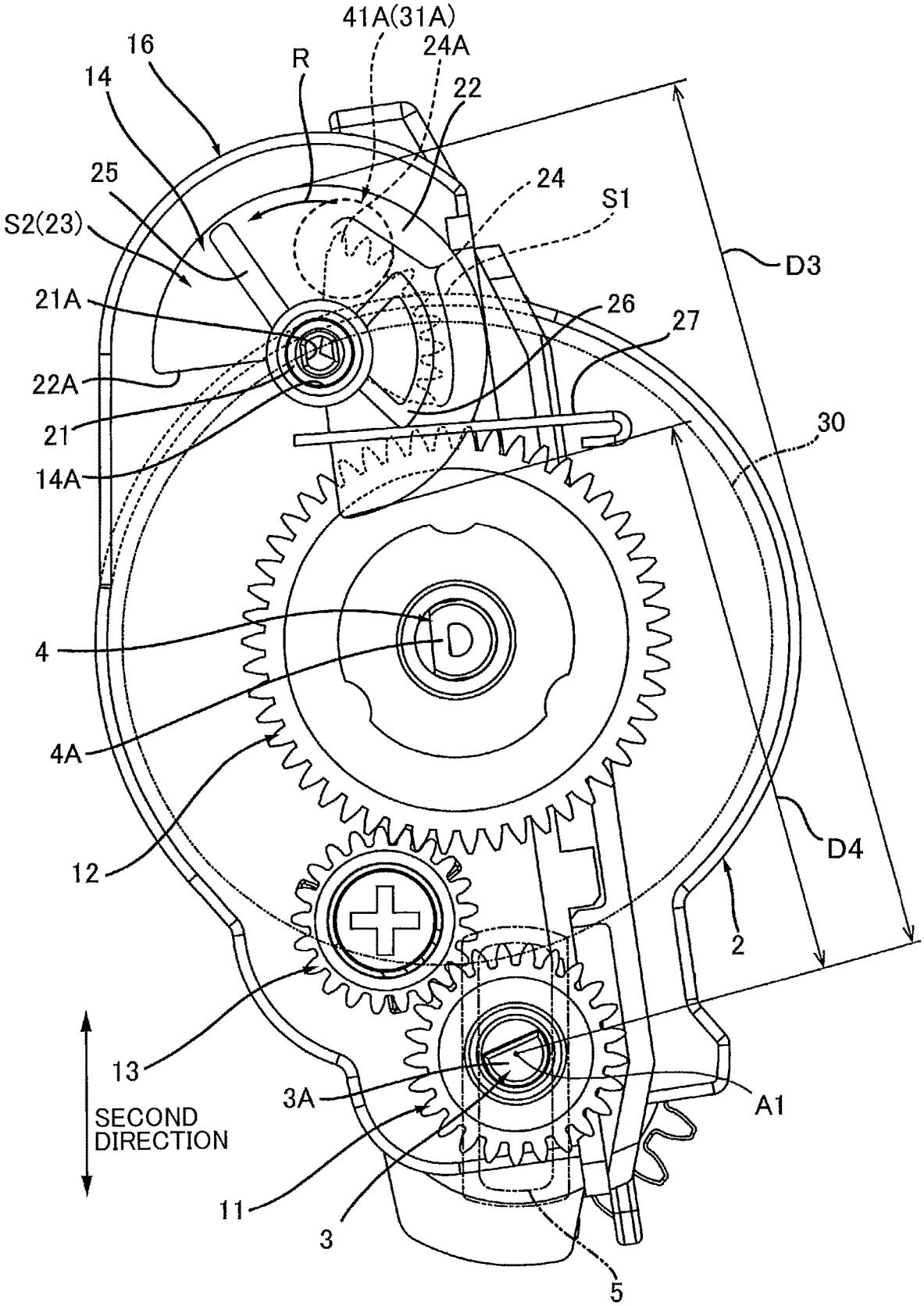
FIG. 4 is a side view of the toner cartridge according to the embodiment without the gear cover in a case where the detection gear is at a second position.

Specifically, the detection gear 14 is rotatable from a first position (shown in FIG. 3) to a second position (shown in FIG. 4). Referring to FIG. 3, the detection gear 14 is positioned opposite to the auger gear 11 with respect to the agitator gear 12 in the second direction. Further, the detection gear 14 is positioned opposite to the first protrusion 5 (refer to phantom lines in FIG. 3) with respect to the agitator gear 12 in the second direction.

Also, the detection gear 14 is positioned at the first end portion E1 of the casing 2 in the first direction. Specifically, the detection gear 14 is rotatably attached to the first end portion E1 of the casing 2 in the first direction. More specifically, the detection gear 14 is supported by a boss 21 disposed at the first end portion E1 of the casing 2. The boss 21 extends outward in the first direction from the first end portion E1 of the casing 2. That is, the toner cartridge 1 includes the boss 21. The boss 21 is cylindrical shaped. The boss 21 has a distal end portion. The distal end portion of the boss 21 has a first hole 21A. The detection gear 14 includes a second hole 14A. The second hole 14A is circular shaped in a plan view. The boss 21 of the casing 2 is fitted into the second hole 14A of the detection gear 14 so that the detection gear 14 is rotatable about the boss 21.

1.9 Gear Cover 15

As shown in FIG. 1, the gear cover 15 is attached to the first end portion E1 of the casing 2. The gear cover 15 covers a portion of the auger gear 11, the agitator gear 12, the idle gear 13, and the detection gear 14. A protrusion 33 (see FIG. 6) is positioned at an inner surface of the gear cover 15. The protrusion 33 extends in the first direction from the inner surface of the gear cover 15. The protrusion 33 is fitted into the first hole 21A of the boss 21 and the second hole 14A of the detection gear 14 when the gear cover 15 is attached to the first end portion E1 of the casing 2.

1.10 Frame 16

As shown in FIG. 1, the frame 16 is positioned at the first end portion E1 of the casing 2 and extends in the second direction from an outer surface S1 of the casing 2. Specifically, referring to FIG. 3, the outer surface S1 is an outer surface of another end portion of the casing 2 in the second direction, the other end portion being opposite to the one end portion of the casing 2 in the second direction (i.e., the one end portion is a portion of the casing 2 at which the auger 3 and auger gear 11 are positioned). The frame 16 covers the detection gear 14 together with the gear cover 15 attached to the casing 2. In other words, the frame 16 and the gear cover 15 accommodate the detection gear 14 therein.

1.11 Handle 17

The handle 17 is provided at a center portion of the casing 2 in the first direction. The handle 17 is positioned opposite to the gear cover 15 with respect to the frame 16 positioned at the first end portion E1 of the casing 2 in the first direction. The handle 17 is positioned on the outer surface S1 of the other end portion of the casing 2 in the second direction. The handle 17 extends from the outer surface S1 to protrude away from the auger 3 in the second direction.

2. Structure of Detection Gear 14

Figure 5A:
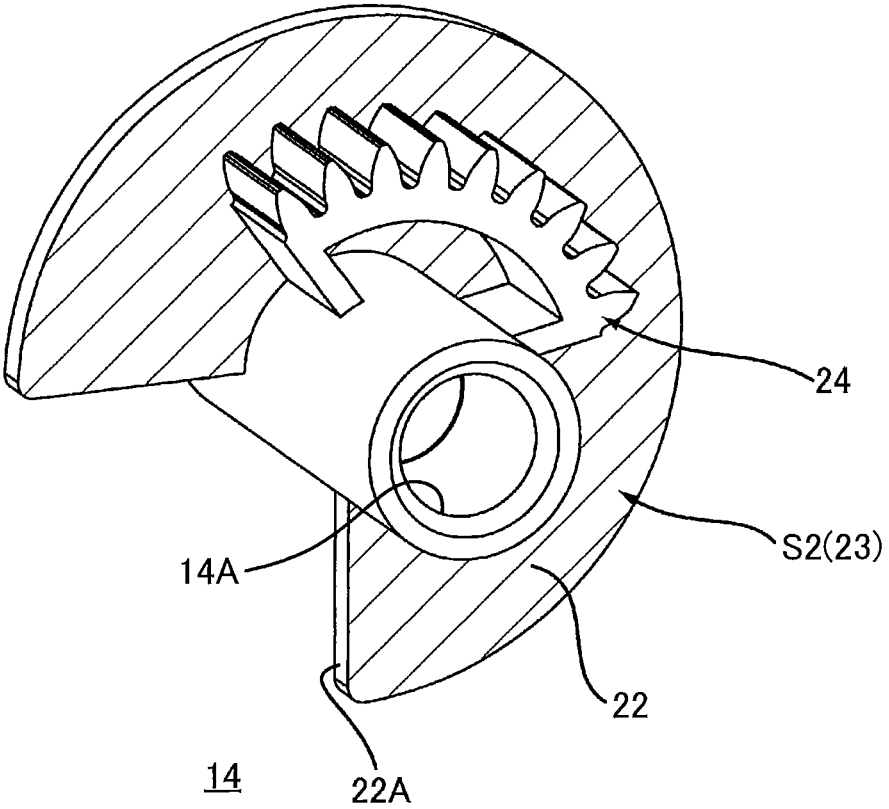
FIG. 5A is a perspective view of the detection gear illustrated in FIG. 3.

As shown in FIGS. 3, 4, 5A and 5B, the detection gear 14 has a generally plate-like shape. Specifically, the detection gear 14 includes a shaft portion, a main body 22, a plurality of gear teeth 24, a first rib 25 (see FIG. 3), and a second rib 26 (see FIG. 3). The shaft portion constitutes a center portion of the detection gear 14. The shaft portion has the second hole 14A. The second hole 14A penetrates through the shaft portion in the first direction. The boss 21 of the casing 2 penetrates through the second hole 14A. The shaft portion defines a third axis A3 about which the detection gear 14 is rotatable (see FIG. 5B). The main body 22 extends radially outward from the shaft portion and is generally fan-like shaped. The main body 22 includes a cutout portion 22A provided by cutting out a portion of the main body 22. A portion of the main body 22 other than the cutout portion 22A has an outer surface S2 (see FIGS. 3 and 4). In the present embodiment, the outer surface S2 of the portion of the main body 22 other than the cutout portion 22A (hereinafter, referred to as "the outer surface S2 of the main body 22" for simplifying explanation) serves as a light-blocking portion 23 of the detection gear 14. That is, the outer surface S2 (light-blocking portion 23) is a portion that is different from the cutout portion 22A in the detection gear 14. In FIG. 5A, the outer surface S2 of the main body 22 (light-blocking portion 23) is shown as a shaded area.

2.1 Cutout Portion 22A and Outer Surface S2

The cutout portion 22A (a portion cut out from the main body 22) is a portion of the detection gear 14 through which light L (described later) coming from a light-emitting element 125 of the image-forming apparatus 120 is allowed to pass. The outer surface S2 (light-blocking portion 23) is a portion of the detection gear 14 that is configured to block the light L coming from the light-emitting element 125 of the image-forming apparatus 120. The outer surface S2 of the detection gear 14 is aligned with the cutout portion 22A in a rotational direction R of the detection gear 14 (see FIGS. 3 and 4). That is, the light-blocking portion 23 is aligned with the cutout portion 22A in the rotational direction R of the detection gear 14.

In a case where the detection gear 14 is at the first position shown in FIG. 3, at least a portion of the cutout portion 22A is positioned farther away from the auger 3 than the outer surface S1 of the casing 2 is from the auger 3.

In the case there the detection gear 14 is at the first position, a distance D1 between the outer surface S2 of the detection gear 14 and the auger 3 in the second direction that is smaller than a distance D2 between the cutout portion 22A and the auger 3 in the second direction. That is, in the case where the detection gear 14 is at the first position, the distance D1 between the light-blocking portion 23 and the auger 3 in the second direction is smaller than the distance D2 between the cutout portion 22A and the auger 3 in the second direction.

More specifically, the distance D1 is defined as a distance between an outer edge of the outer surface S2, which is positioned closest to the auger 3 in the second direction, and the first axis A1 of the auger 3 in the case where the detection gear 14 is at the first position. The distance D2 is defined as a distance between an outer edge of the cutout portion 22A, which is positioned farthest from the auger 3, and the first axis A1 of the auger 3 in the case where the detection gear 14 is at the first position. That is, in the case where the detection gear 14 is at the first position, the distance D1 between the outer edge of the outer surface S2, which is positioned closest to the auger 3 in the second direction, and the first axis A1 of the auger 3 is smaller than the distance D2 between the outer edge of the cutout portion 22A, which is positioned farthest from the auger 3 in the second direction, and the first axis A1 of the auger 3. Put another way, in the case where the detection gear 14 is at the first position, the distance D1 between the outer edge of the light-blocking portion 23, which is closest to the auger 3 in the second direction, and the first axis A1 is smaller than the distance D2 between the outer edge of the cutout portion 22A, which is farthest from the auger 3 in the second direction, and the first axis A1.

Further, in the case where the detection gear 14 is at the first position, at least a portion of the cutout portion 22A is positioned outside a rotational trajectory 30 of the agitator 4. The rotational trajectory 30 of the agitator 4 is a trajectory defined by the rotation of the main portion 4B while the agitator 4 rotates.

That is, in the case where the detection gear 14 is at the first position, at least a portion of the cutout portion 22A does not overlap with the casing 2 in the first direction.

On the other hand, at least a portion of the outer surface S2 of the detection gear 14 overlaps with the casing 2 in the first direction in the case where the detection gear 14 is at the first position. That is, in the case where the detection gear 14 is at the first position, at least a portion of the light-blocking portion 23 overlaps with the casing 2 in the first direction.

As shown in FIG. 4, in a case where the detection gear 14 is at the second position, at least a portion of the outer surface S2 of the detection gear 14 is positioned farther away from the auger 3 than the outer surface S1 of the casing 2 is from the auger 3 in the second direction. That is, in the case where the detection gear 14 is at the second position, at least a portion of the light-blocking portion 23 is positioned farther away from the auger 3 than the outer surface S1 of the casing 2 is from the auger 3 in the second direction.

Further, in the case where the detection gear 14 is at the second position, a distance D3 between the outer surface S2 of the detection gear 14 and the auger 3 in the second direction is larger than a distance D4 between the cutout portion 22A and the auger 3 in the second direction. In other words, the distance D3 between the light-blocking portion 23 and the auger 3 in the second direction is larger than the distance D4 between the cutout portion 22A and the auger 3 in the second direction in the case where the detection gear 14 is at the second position.

More specifically, the distance D3 is defined as a distance between an outer edge of the outer surface S2 of the detection gear 14, which is farthest from the auger 3 in the second direction, and the first axis A1 in the case where the detection gear 14 is at the second position. The distance D4 is a distance defined between an outer edge of the cutout portion 22A, which is closest to the auger 3 in the second direction, and the first axis A1 in the case where the detection gear 14 is at the second position. That is, in the case where the detection gear 14 is at the second position, the distance D3 between the outer edge of the outer surface S2 of the detection gear 14, which is farthest from the auger 3 in the second direction, and the first axis A1 of the auger 3 is larger than the distance D4 between the outer edge of the cutout portion 22A, which is closest to the auger 3 in the second direction, and the first axis A1 of the auger 3. In other words, in the case where the detection gear 14 is at the second position, the distance D3 between the outer edge of the light-blocking portion 23, which is farthest from the auger 3 in the second direction, and the first axis A1 is larger than the distance D4 between the outer edge of the cutout portion 22A, which is closest to the auger 3 in the second direction, and the first axis A1.

Further, at least a portion of the outer surface S2 of the detection gear 14 is positioned outside the rotational trajectory 30 of the agitator 4 in the case where the detection gear 14 is at the second position. That is, at least a portion of the light-blocking portion 23 is positioned outside the rotational trajectory 30 of the agitator 4 in the case where the detection gear 14 is at the second position.

That is, at least a portion of the cutout portion 22A overlaps with the casing 2 in the first direction in the case where the detection gear 14 is at the second position.

On the other hand, at least a portion of the outer surface S2 of the detection gear 14 does not overlap with the casing 2 in the first direction in the case where the detection gear 14 is at the second position. In other words, at least a portion of the light-blocking portion 23 does not overlap with the casing 2 in the first direction in the case where the detection gear 14 is at the second position.

2.2 Gear Teeth 24

Figure 5B:
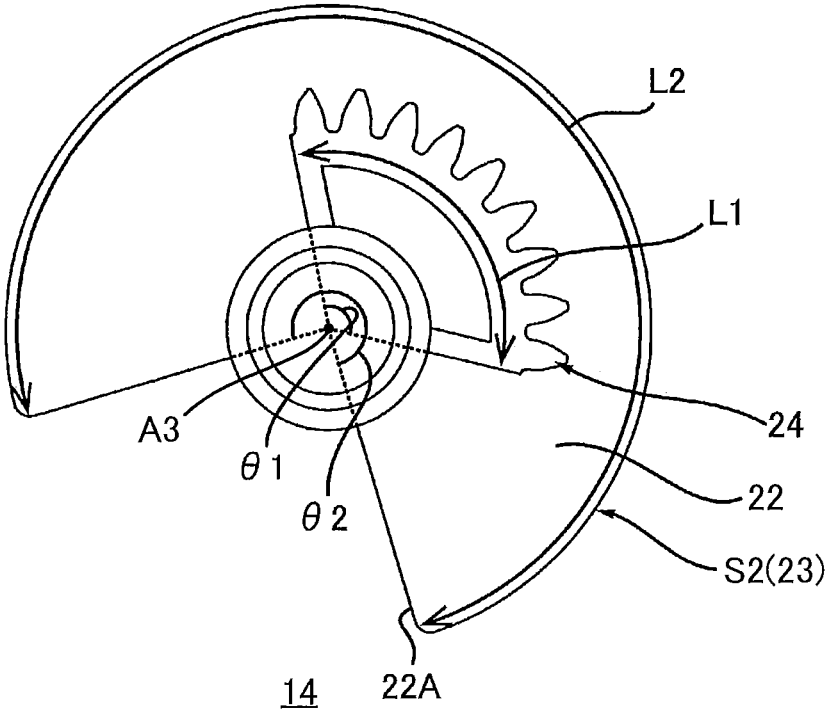
FIG. 5B is an explanatory view illustrating a structure of the detection gear shown in FIG. 5A.

As shown in FIG. 5A, the plurality of gear teeth 24 is positioned at the outer surface S2 of the main body 22. More specifically, in the first direction, the gear teeth 24 are positioned between the casing 2 (first end portion E1) and the outer surface S2 of the main body 22. That is, the plurality of gear teeth 24 is positioned between the casing 2 (first end portion E1) and the light-blocking portion 23 of the detection gear 14 in the first direction. The gear teeth 24 are aligned with each other in the rotational direction R (see FIG. 3) of the detection gear 14. The detection gear 14 has a diameter that is larger than the diameter of the auger gear 11 and that is smaller than the diameter of the agitator gear 12. Further, as shown in FIG. 5B, the plurality of gear teeth 24 defines a length L1 in the rotational direction R of the detection gear 14 that is smaller than a length L2 of the outer surface S2 in the rotational direction R of the detection gear 14. That is, the length L1 of the plurality of gear teeth 24 in the rotational direction R of the detection gear 14 is smaller than the length L2 of the light-blocking portion 23 in the rotational direction R of the detection gear 14. Put another way, the plurality of gear teeth 24 defines a central angle θ1 about the third axis A3 that is smaller than a central angle θ2 that the outer surface S2 of the detection gear 14 defines about the third axis A3. In other words, the central angle θ1 of the plurality of gear teeth 24 about the third axis A3 is smaller than the central angle θ2 of the light-blocking portion 23 about the third axis A3.

As shown in FIG. 3, in the case where the detection gear 14 is at the first position, at least one of the plurality of gear teeth 24 meshes with the agitator gear 12. More specifically, one of the plurality of gear teeth 24 that is positioned most downstream in the rotational direction R of the detection gear 14 (hereinafter, referred to as a "most-downstream gear tooth 24A") is in mesh with the agitator 4. Accordingly, the detection gear 14 is configured to rotate from the first position to the second position in accordance with rotation of the agitator gear 12. Further, in the case where the detection gear 14 is at the first position, at least a portion of the plurality of gear teeth 24 overlaps with the rotational trajectory 30 of the agitator 4 in the first direction. Specifically, in the case where the detection gear 14 is at the first position, the most-downstream gear tooth 24A of the plurality of gear teeth 24 overlaps with the rotational trajectory 30 of the agitator 4 in the first direction.

As shown in FIG. 4, in the case where the detection gear 14 is at the second position, none of the gear teeth 24 meshes with the agitator gear 12. Accordingly, the detection gear 14 stops rotating at the second position. Further, in the case where the detection gear 14 is at the second position, at least a portion of the plurality of gear teeth 24 does not overlap with the rotational trajectory 30 of the agitator 4 in the first direction. Specifically, in the cases where the detection gear 14 is at the second position, the most-downstream gear tooth 24A of the plurality of gear teeth 24 does NOT overlap with the rotational trajectory 30 of the agitator 4 in the first direction.

2.3 First Rib 25 and Second Rib 26

As shown in FIG. 3, the first rib 25 and the second rib 26 are positioned at the main body 22. More specifically, the first rib 25 and second rib 26 are positioned opposite to the gear teeth 24 with respect to the main body 22 (the light-blocking portion 23 and the outer surface S2) in the first direction. In the case where the detection gear 14 is at the first position, the first rib 25 is pressed (urged) by a spring 27 toward downstream in the rotational direction R of the detection gear 14. By this urging of the spring 27, the detection gear 14 is maintained at the first position with at least one of the plurality of gear teeth 24 (most-downstream gear tooth 24A) meshing with the agitator gear 12. As shown in FIG. 4, in the state where the detection gear 14 is at the second position, the second rib 26 is pressed by the spring 27 toward downstream in the rotational direction R of the detection gear 14. The detection gear 14 is thus positioned at the second position, with the plurality of gear teeth 24 separated from the agitator gear 12.

3. Structure of Gear Cover 15

Figure 6:
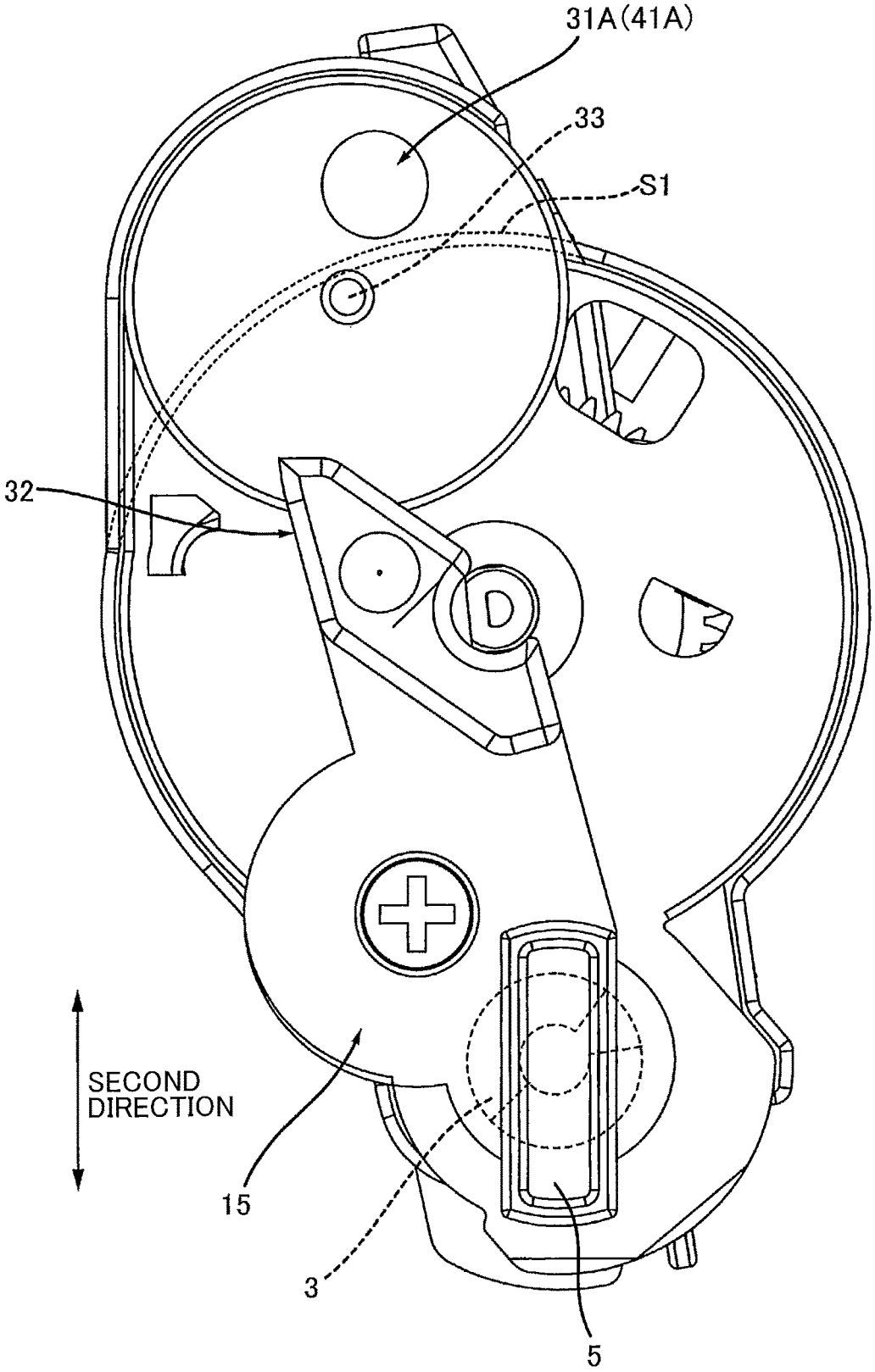
FIG. 6 is a side view of the toner cartridge according to the embodiment including the gear cover.

As shown in FIG. 6, the gear cover 15 includes a second hole 31A. The second hole 31A is a through-hole through which the light L coming from the light-emitting element 125 is allowed to pass. The second hole 31A is positioned farther away from the auger 3 than the outer surface S1 of the casing 2 is from the auger 3 in the second direction.

Figure 9:
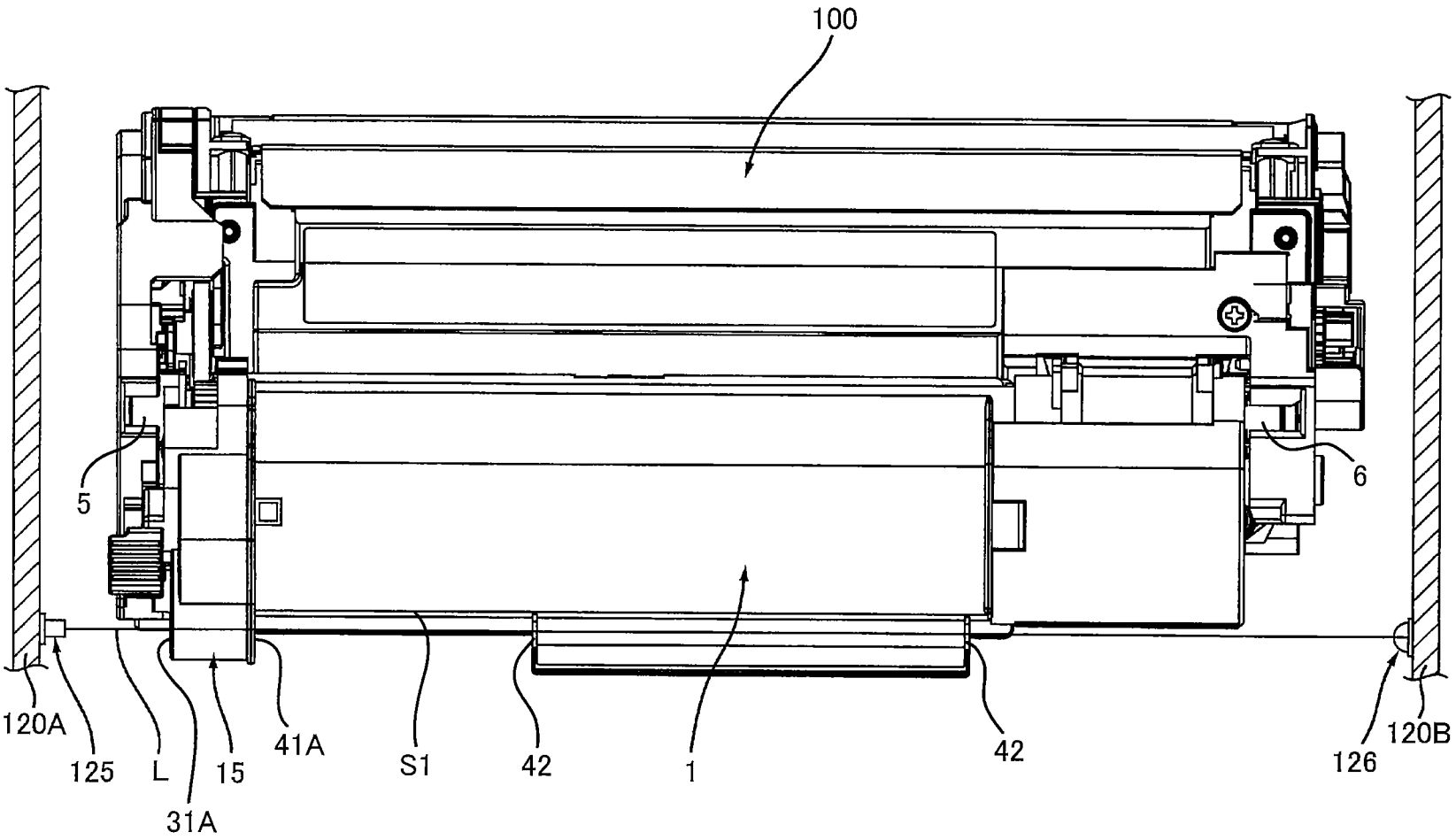
FIG. 9 is an explanatory diagram illustrating a positional relationship among the toner cartridge according to the embodiment, a light-emitting element and a light-receiving element in a state where the toner cartridge according to the embodiment attached to the developing device is attached to the image-forming apparatus.

More specifically, as shown in FIGS. 3 and 6, the second hole 31A is aligned with the cutout portion 22A of the detection gear 14 at the first position in the first direction. With this structure, as shown in FIG. 9, the light L can pass through the second hole 31A and then through the cutout portion 22A of the detection gear 14 at the first position.

In the case where the detection gear 14 is at the second position, the outer surface S2 of the detection gear 14 is aligned with the second hole 31A of the gear cover 15 in the first direction (see a broken line indicating the position of the second hole 31A in FIG. 4). With this structure, the light L having passed through the second hole 31A is blocked by the outer surface S2 of the detection gear 14 in the first direction. That is, in the state where the detection gear 14 is at the second position, the light-blocking portion 23 is aligned with the second hole 31A in the first direction. Accordingly, the light L having passed through the second hole 31A can be blocked by the light-blocking portion 23 in the first direction.

As shown in FIG. 6, the gear cover 15 further includes a lock portion 32.

The lock portion 32 is positioned on an outer surface of the gear cover 15. The lock portion 32 projects from the outer surface of the gear cover 15 outward in the first direction. The lock portion 32 is positioned between the auger 3 and the second hole 31A in the second direction. The lock portion 32 extends in the second direction. The lock portion 32 is configured to be locked by a locking member 101 (see FIG. 7) of a developing device 100 (described later) when the toner cartridge 1 is attached to the developing device 100. This locking of the lock portion 32 by the locking member 101 can prevent the detection gear 14 from vibrating, thereby preventing displacement of the cutout portion 22A relative to the second hole 31A. As a result, the light L emitted from the light-emitting element 125 can be reliably received at a light-receiving element 126 of the image-forming apparatus 120 (described later, see FIG. 9).

4. Structure of Frame 16

As shown in FIGS. 1 and 3, the frame 16 has a third hole 41A. The third hole 41A is a through-hole through which the light L is allowed to pass therethrough. The third hole 41A is aligned with the second hole 31A (see FIG. 6) in the first direction. This structure allows the light L to be focused while passing through the third hole 41A, thereby enabling the light-receiving element 126 (see FIG. 9) to reliably detect the light L emitted from the light-emitting element 125 (see FIG. 9). In the case where the detection gear 14 is at the first position shown in FIG. 3, the third hole 41A is aligned with the cutout portion 22A of the detection gear 14 in the first direction. Accordingly, the light L having passed through the second hole 31A and the cutout portion 22A can further pass through the third hole 41A in the first direction.

5. Structure of Handle 17

As shown in FIG. 1, the handle 17 includes a pair of recessed portions 42. The recessed portions 42 are positioned one at each end of the handle 17 in the first direction. Each recessed portion 42 is recessed to be shaped in conformance with an outer profile of each of the second hole 31A and the third hole 41A. That is, each recessed portion 42 does not have any portion overlapping with the second hole 31A and the third hole 41A in the first direction. Accordingly, the light L emitted from the light-emitting element 125 (see FIG. 9) can pass through the recessed portions 42 in the first direction without being blocked by the handle 17. Specifically, the light L emitted from the light-emitting element 125 can pass sequentially through the second hole 31A, the cutout portion 22A, and the third hole 41A, and the recessed portions 42 of the handle 17.

6. Attachment of Toner Cartridge 1 to Developing Device 100

Figure 7A:
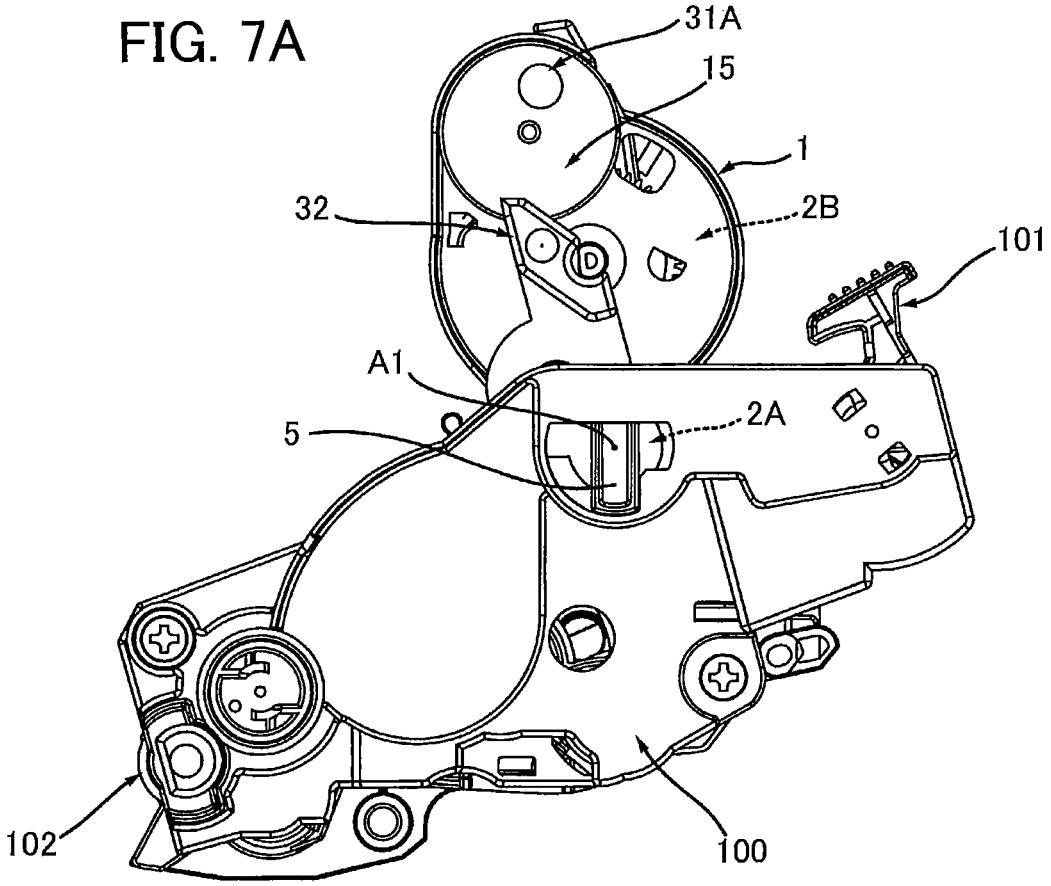
FIG. 7A is a view illustrating a state where the toner cartridge according to the embodiment is placed at a developing device prior to attachment of the toner cartridge to the developing device.
Figure 7B:
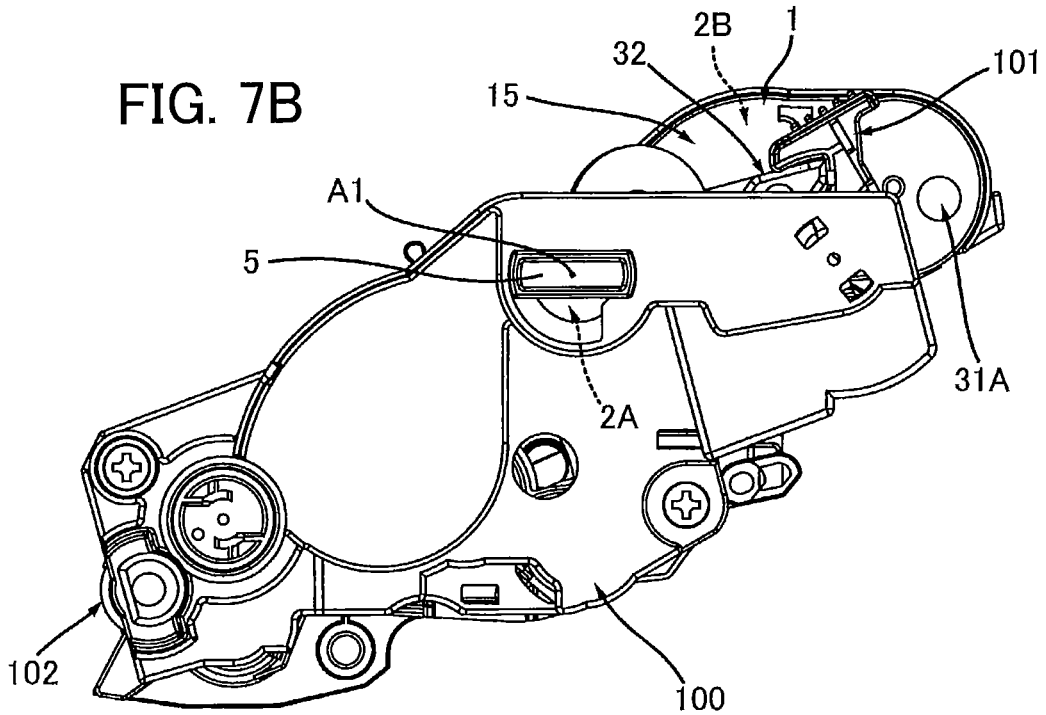
FIG. 7B is a view illustrating a state where the toner cartridge according to the embodiment is attached to the developing device.

Next, how the toner cartridge 1 is attached to the developing device 100 including a developing roller 102 will be described with reference to FIGS. 7A and 7B.

First, the first protrusion 5 and the second protrusion 6 of the toner cartridge 1 are inserted in the developing device 100 and placed at the developing device 100. Once the toner cartridge 1 is placed at the developing device 100, the toner cartridge 1 is then pivoted from a state shown in FIG. 7A to a state shown in FIG. 7B. At this time, since the detection gear 14 is positioned opposite to the first protrusion 5 (pivot center) with respect to the lock portion 32 in the second direction as shown in FIG. 3, the detection gear 14 does not interfere the pivoting of the toner cartridge 1 relative to the developing device 100 (attachment of the toner cartridge 1 to the developing device 100). When the toner cartridge 1 is in the state shown in FIG. 7B, the lock portion 32 of the toner cartridge 1 is locked by the locking member 101 provided at the developer unit 100, as described earlier. The attachment of the toner cartridge 1 attached to the developing device 100 is thus completed.

Figure 8:
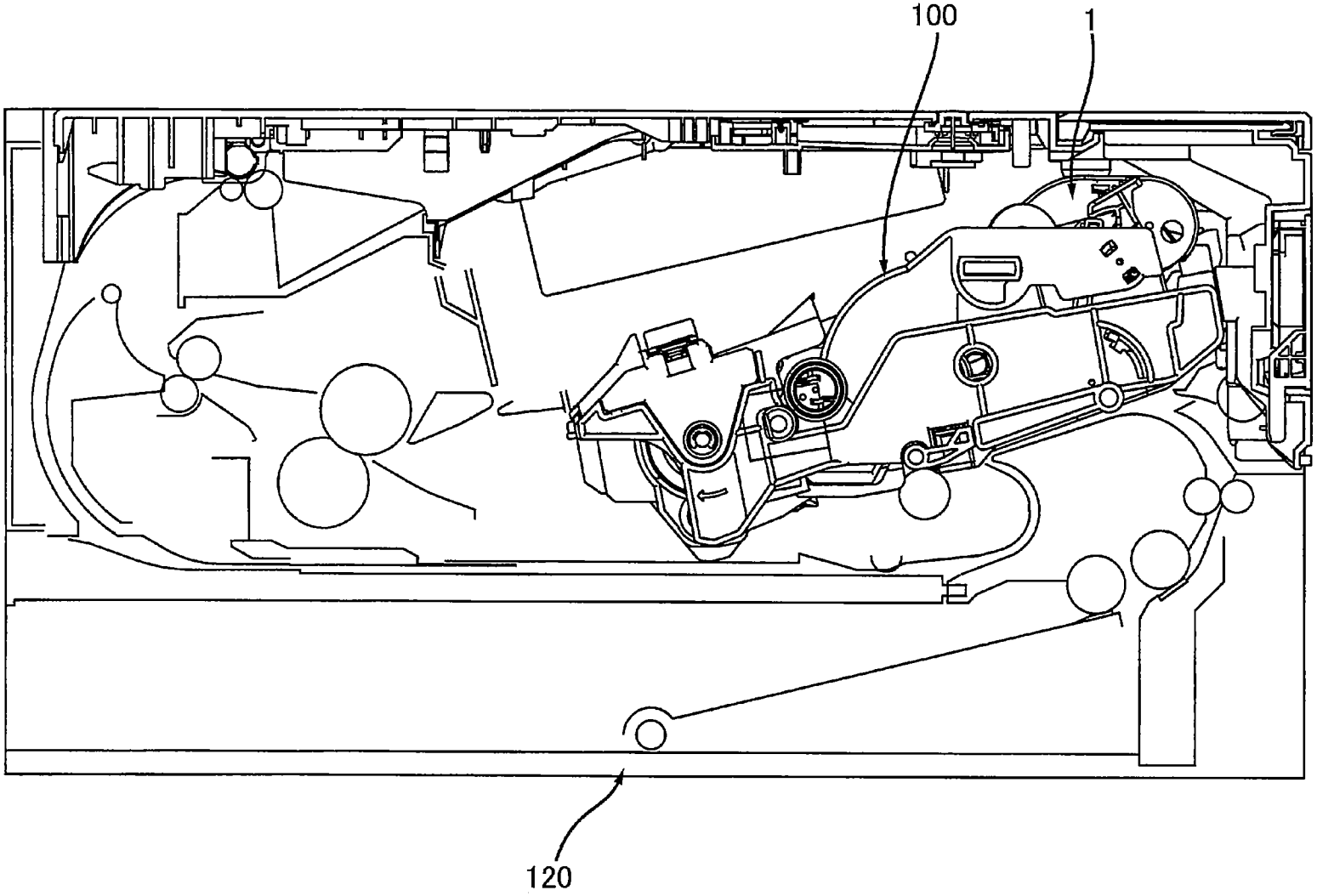
FIG. 8 is a diagram illustrating a state where the toner cartridge according to the embodiment attached to the developing device is attached to an image-forming apparatus.

Here, the phrase "the toner cartridge 1 pivots" means that the toner cartridge 1 pivots about the first axis A1 of the auger 3. The phrase "the toner cartridge 1 is placed at the developing device 100" means a state where: the toner cartridge 1 is incapable of supplying toner to the developing device 100; and a vertical position of the toner cartridge 1 relative to the developer unit 100 is fixed, but the toner cartridge 1 is not yet pivoted relative to the developing device 100 (the state shown in FIG. 7A). On the other hand, the phrase "the toner cartridge 1 is attached to the developing device 100" means a state where: the toner cartridge 1 is able to supply toner to the developing device 100; and the toner cartridge 1 has pivoted relative to the developing device 100 (the state shown in FIG. 7B). The toner cartridge 1 attached to the developing device 100 is then attached to and detached from the image-forming apparatus 120, as shown in FIG. 8.

7. Attachment of Toner Cartridge 1 to Image-Forming Apparatus 120

Next, how the toner cartridge 1 is attached to the image-forming apparatus 120 will be described with reference to FIG. 9.

As shown in FIG. 9, the image-forming apparatus 120 includes a first side wall 120A, a second side wall 120B, the light-emitting element 125, and the light-receiving element 126.

The first side wall 120A faces the gear cover 15 of the toner cartridge 1 in the first direction in a state where the toner cartridge 1 attached to the developing device 100 is attached to the image-forming apparatus 120. The first side wall 120A supports the light-emitting element 125.

The second side wall 120B is spaced apart from the first side wall 120A in the first direction. The toner cartridge 1 is positioned between the first side wall 120A and the second side wall 120B in the state where the toner cartridge 1 attached to the developing device 100 is attached to the image-forming apparatus 120. In other words, in a state where the toner cartridge 1 and the developing device 100 are attached to the image-forming apparatus 120, the second side wall 120B is positioned opposite to the first side wall 120A with respect to the toner cartridge 1 and the developing device 100 in the first direction. The second side wall 120B supports the light-receiving element 126.

In the state where the developing device 100 and the toner cartridge 1 are attached to the image-forming apparatus 120, the light-emitting element 125 faces the second hole 31A of the gear cover 15 of the toner cartridge 1 (see FIG. 7B) in the first direction. In the state where the toner cartridge 1 attached to the developing device 100 is attached to the image-forming apparatus 120, the light-emitting element 125 is configured to emit the light L toward the second hole 31A in a direction parallel to the first direction.

The light-receiving element 126 is disposed to be spaced apart from the light-emitting element 125 in the first direction. The light-receiving element 126 faces the light-emitting element 125 in the first direction.

The cutout portion 22A (see FIG. 3) of the detection gear 14 at the first position is positioned between the light-emitting element 125 and the light-receiving element 126 in the first direction, in the state where the toner cartridge 1 is attached to the image-forming apparatus 120.

Accordingly, the light L passing through the second hole 31A (see FIG. 6), the cutout portion 22A and the third hole 41A (see FIG. 3) is received by the light-receiving element 126, in a state where the toner cartridge 1 is attached to the image-forming apparatus 120 and the detection gear 14 is at the first position.

On the other hand, in a state where the toner cartridge 1 is attached to the image-forming apparatus 120 and the detection gear 14 is at the second position, the outer surface S2 of the detection gear 14 is positioned between the light-emitting element 125 and the light-receiving element 126 in the first direction. In other words, the light-blocking portion 23 of the detection gear 14 at the second position is positioned between the light-emitting element 125 and the light-receiving element 126 in the first direction, in a state where the toner cartridge 1 is attached to the image-forming apparatus 120.

Accordingly, in case where the toner cartridge 1 is attached to the image-forming apparatus 120 and the detection gear 14 is at the second position, the light L emitted from the light-emitting element 125 is blocked by the outer surface S2 of the detection gear 14 at the second position, and is not received by the light-receiving element 126. In other words, the light L is blocked by the light-blocking portion 23 of the detection gear 14 at the second position, and is not received by the light-receiving element 126, in the state where the toner cartridge 1 is attached to the image-forming apparatus 120 and the detection gear 14 is at the second position.

8. Operations in Toner Cartridge 1

Next, operations performed in the toner cartridge 1 when the image-forming apparatus 120 reads information on the toner cartridge 1 will be described with reference to FIGS. 3, 4 and 9.

In a state where the toner cartridge 1 is attached to the image-forming apparatus 120 and the detection gear 14 is at the first position, as shown in FIG. 9, the light L from the light-emitting element 125 passes sequentially through the second hole 31A, the cutout portion 22A of the detection gear 14 (see FIG. 3), and the third hole 41A, and is finally received by the light-receiving element 126. The light-receiving element 126 thus detects the light L.

Subsequently, the image-forming apparatus 120 performs an operation to read information on the toner cartridge 1 (hereinafter, referred to as a "reading operation"). Once the image-forming apparatus 120 starts the reading operation, the auger gear 11 is configured to rotate upon receipt of a driving force from the image-forming apparatus 120.

In accordance with rotation of the auger gear 11, the driving force is transmitted to the detection gear 14 via the idle gear 13 and the agitator gear 12, as shown in FIGS. 3 and 4, thereby causing the detection gear 14 to rotate from the first position shown in FIG. 3 to the second position shown in FIG. 4. In a case where the detection gear 14 rotates to the second position, the gear teeth 24 are separated from the agitator gear 12, causing the detection gear 14 to stop rotating.

The light L is therefore blocked by the outer surface S2 of the detection gear 14 at the second position, and is not received by the light-receiving element 126. Thus, the light-receiving element 126 does not detect the light L.

In a case where the light-receiving element 126 initially detects the light L but subsequently does not detect the light L while performing the reading operation, the image-forming apparatus 120 determines that the toner cartridge 1 is new.

On the other hand, in a case where the detection gear 14 is already at the second position in the state where the toner cartridge 1 is attached to the image-forming apparatus 120, the detection gear 14 cannot rotate even if the image-forming apparatus 120 performs the reading operation, since the plurality of gear teeth 24 are already disengaged from the agitator gear 12. Accordingly, the light-receiving element 126 does not detect the light L while the reading operation is performed by the image-forming apparatus 120. If this is the case, the image-forming apparatus 120 determines that the toner cartridge 1 is not new.

Note that whether or not the toner cartridge 1 is new is an example of information on the toner cartridge 1. Alternatively, the information on the toner cartridge 1 may be on how many numbers of sheets printing can be performed with the toner cartridge 1.

Further, in a case where the light-receiving element 126 does not detect the light L after the image-forming apparatus 120 has performed the reading operation, the image-forming apparatus 120 determines that the toner cartridge 1 is attached.

On the other hand, in a case where the light L is not blocked and the light-receiving element 126 continues to detect the light L after the image-forming apparatus 120 has performed the reading operation, the image-forming apparatus 120 determines that the toner cartridge 1 is not attached.

9. Operational and Technical Advantages

In the toner cartridge 1, the detection gear 14 is positioned opposite to the auger gear 11 with respect to the agitator gear 12 in the second direction, as shown in FIG. 3. In the case where the detection gear 14 is at the first position, the cutout portion 22A is positioned farther away from the auger 3 than the outer surface S1 of the casing 2 (other end portion of the casing 2 in the second direction) is from the auger 3. On the other hand, in the case where the detection gear 14 is at the second position, the outer surface S2 of the detection gear 14 is positioned farther away from the auger 3 than the outer surface S1 is from the auger 3.

With this structure, in the toner cartridge 1 in which toner is conveyed by the auger 3 and the agitator 4, the movement of the detection gear 14 can be detected by the image-forming apparatus 120, even if the casing 2 of the toner cartridge 1 attached to the image-forming apparatus 120 is positioned to be interposed between the light-emitting element 125 and the light-receiving element 126 in the first direction.

10. Variations and Modifications 10.1 Modifications of Detection Gear 14

Figure 10A:
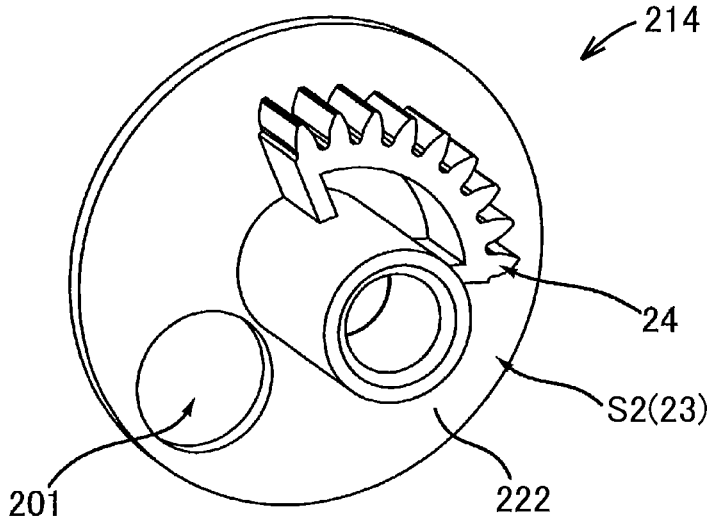
FIG. 10A is a perspective view of a detection gear according to a first modification to the embodiment, the detection gear having a through-hole.

FIG. 10A shows a detection gear 214 according to a first modification to the embodiment. The detection gear 214 has a hole 201, instead of the cutout portion 22A. Specifically, the detection gear 214 includes a main body 222, and the main body 222 has the hole 201. The hole 201 is a circular-shaped through-hole.

Figure 10B:
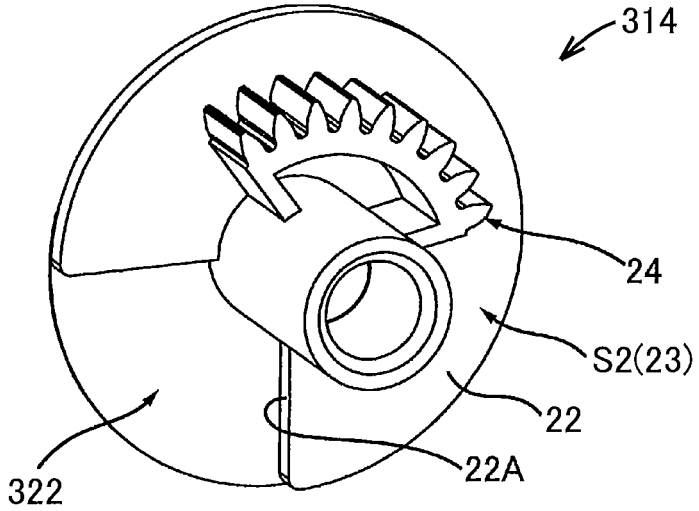
FIG. 10B is a perspective view of a detection gear according to a second modification to the embodiment, the detection gear including a light-transmission portion.

FIG. 10B shows a detection gear 314 according to a second modification to the embodiment. The detection gear 314 includes a light-transmission portion 322 covering the cutout portion 22A. The light-transmission portion 322 is a material having a light transmission capability that is higher than the light transmission capability the outer surface S2 of the main body 22 of the detection gear 314. That is, the light transmission capability of the light-transmission portion 322 is higher than the light transmission capability of the light-blocking portion 23. The light-transmission portion 322 may be configured by a transparent film, or a transparent plate. Or the light-transmission portion 322 may cover the hole 201 of the detection gear 214 according to the first modification. The light-transmission portion 322 covering the cutout portion 22A or the hole 201 may be provided as a separate member and attached to the main body 22. Alternatively, the light-transmission portion 322 may be provided so as to fill the cutout portion 22A or the hole 201, and may be integral with the main body 22 to constitute the detection gear 14.

Figure 10C:
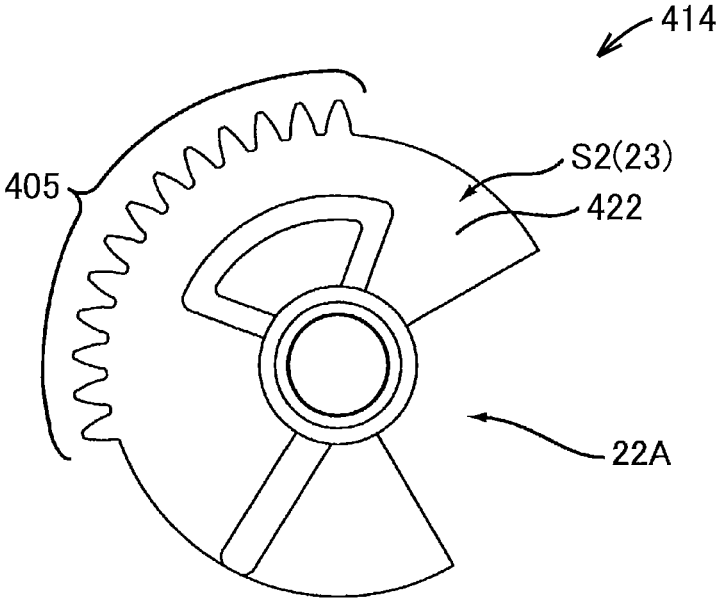
FIG. 10C is a plan view of a detection gear according to a third modification to the embodiment, the detection gear including gear teeth positioned radially outward of an outer surface (light-blocking portion) of a main body of the detection gear.

FIG. 10C shows a detection gear 414 according to a third modification to the embodiment. The detection gear 414 includes a plurality of gear teeth 405, instead of the gear teeth 24. The plurality of gear teeth 405 is provided on a peripheral surface of a portion of a main body 422 to extend therealong. Specifically, the gear teeth 405 are positioned outward of the outer surface S2 of the main body 422 in a radial direction of the detection gear 414. That is, the gear teeth 405 are positioned outward of the light-blocking portion 23 in the radial direction of the detection gear 414.

Still alternatively, the detection gear 14 may include a friction portion, instead of the plurality of gear teeth 24. The friction portion may be provided to make contact with the agitator gear 12 to generate a frictional force to rotate the detection gear 14. The friction portion may contact the agitator gear 12 in the case where the detection gear 14 is at the first position, while the friction portion may not contact the agitator gear 12 in the case where the detection gear 14 is at the second position. The friction portion may be any member, provided that the member can generate a frictional force upon contact with the agitator gear 12. For example, the friction part may be made of rubber.

10.2 Modifications of Gear Cover 15

Figure 11A:
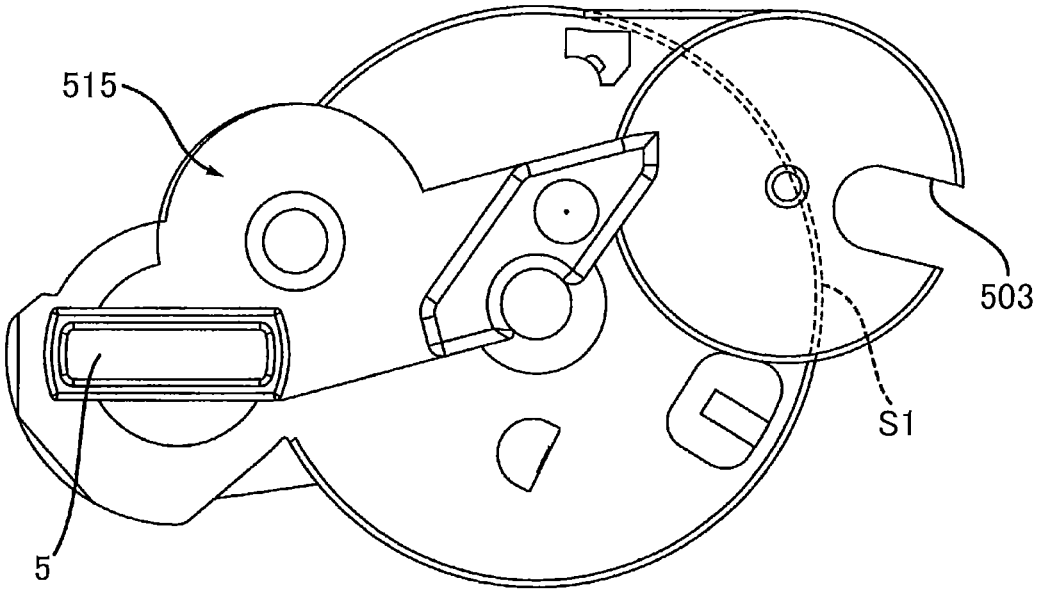
FIG. 11A is a side view of a gear cover according to a fourth modification to the embodiment, the gear cover including a second cutout portion.

FIG. 11A shows a gear cover 515 according to a fourth modification to the embodiment. The gear cover 515 includes a second cutout portion 503, instead of the second hole 31A of the gear cover 15 according to the embodiment.

Figure 11B:
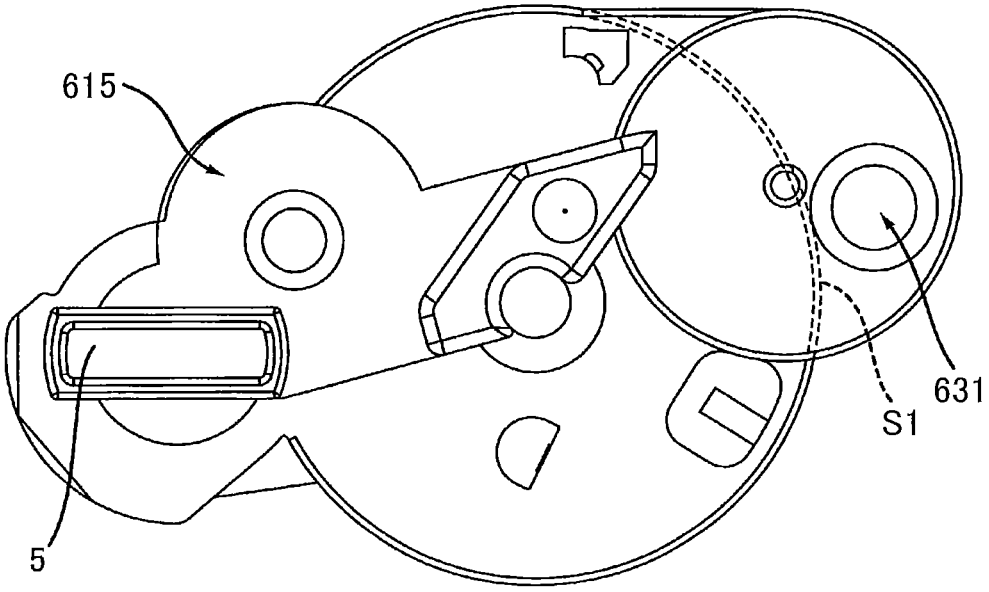
FIG. 11B is a side view of a gear cover according to a fifth modification to the embodiment, the gear cover including a second light-transmission portion.

Alternatively, FIG. 11B shows a gear cover 615 according to a fifth modification to the embodiment. The gear cover 615 includes a second light-transmission portion 631, instead of the second hole 31A or the second cutout portion 503. The second light-transmission portion 631 may be a transparent film, or a transparent plate. The second light-transmission portion 631 may be provided to cover the second hole 31A or the second cutout portion 503. In this case, the second light-transmission portion 631 may be a component separate from the gear cover 15 and attached to the gear cover 15. Alternatively, the second light-transmission portion 631 may be provided so as to fill the second hole 31A or the second cutout portion 503 so as to be formed integrally with the gear cover 15.

10.3 Variations of Frame 16

The frame 16 may have a third cutout, instead of the third hole 41A.

Alternatively, the frame 16 may have a third light-transmission portion, instead of the third hole 41A or the third cutout portion. The third light-transmission portion may be a transparent film, or a transparent plate. The third light-transmission portion may cover the third hole 41A or the third cutout portion. In this case, the third light-transmission portion may be a separate member from the frame 16. Still alternatively, the third light-transmission portion may be provided so as to fill the third hole 41A or the third cutout portion so as to be formed integrally with the frame 16.

While the disclosure is described in detail with reference to the specific embodiments thereof while referring to accompanying drawings, it would be apparent to those skilled in the art that many modifications and variations may be made therein without departing from the scope of the disclosure.

What is claimed is:

1. A toner cartridge comprising:

a casing configured to accommodate toner therein, the casing having a first end portion and a second end portion opposite to each other in a first direction, the second end portion including a toner outlet including a through-hole in an outer surface of the casing of the toner cartridge, the toner outlet being configured to allow the toner in the casing to be discharged outside of the casing of the toner cartridge by passing the toner therethrough;

an auger rotatable about a first axis extending in the first direction, the auger being configured to convey the toner in the first direction;

an auger gear rotatable with the auger, the auger gear being positioned at the first end portion of the casing;

an agitator rotatable about a second axis extending in the first direction, the agitator being configured to convey the toner toward the auger;

an agitator gear rotatable with the agitator, the agitator gear being positioned at the first end portion of the casing; and a detection gear positioned at the first end portion of the casing, the detection gear being positioned on an opposite side of the agitator gear relative to the auger gear in a second direction crossing the first direction, wherein the toner outlet is positioned on an opposite side of the agitator gear as the detection gear in the second direction.

2. The toner cartridge according to claim 1, wherein the auger is positioned at one end portion of the casing in the second direction, and wherein the toner outlet is positioned at the one end portion of the casing in the second direction.

3. The toner cartridge according to claim 1, wherein the agitator is aligned with the auger in the second direction.

4. The toner cartridge according to claim 1, wherein the casing comprises:

a first accommodation portion that accommodates the auger therein; and a second accommodation portion that accommodates the agitator therein, the second direction being a direction in which the first accommodation portion and the second accommodation portion are aligned with each other.

5. The toner cartridge according to claim 1, wherein the second direction is a direction connecting the first axis and the second axis.

6. The toner cartridge according to claim 1, wherein the auger includes an auger shaft extending in the first direction and a helical portion extending from the auger shaft.

7. The toner cartridge according to claim 1, wherein the detection gear has a diameter larger than a diameter of the auger gear, the diameter of the detection gear being smaller than a diameter of the agitator gear.

8. The toner cartridge according to claim 1, further comprising:

a first protrusion positioned at the first end portion of the casing in the first direction; and a second protrusion positioned at the second end portion of the casing in the first direction, the second protrusion being positioned opposite to the auger gear with respect to the casing in the first direction.

9. The toner cartridge according to claim 8, wherein the detection gear is positioned opposite to the first protrusion with respect to the agitator gear in the second direction.

10. The toner cartridge according to claim 1, wherein the detection gear is rotatable from a first position to a second position.

11. The toner cartridge according to claim 10, wherein the detection gear has a plurality of gear teeth, wherein the plurality of gear teeth meshes with the agitator gear in a case where the detection gear is at the first position, and wherein the plurality of gear teeth does not mesh with the agitator gear in a case where the detection gear is at the second position.

12. The toner cartridge according to claim 11, wherein the detection gear has a portion other than the plurality of gear teeth in a rotational direction of the detection gear, wherein the plurality of gear teeth has a length shorter than a length of an outer surface of the portion of the detection gear in the rotational direction of the detection gear.

13. The toner cartridge according to claim 10, wherein the detection gear includes one of a through-hole and a cutout.

14. The toner cartridge according to claim 13, further comprising a gear cover covering the agitator gear and the auger gear and the detection gear, the gear cover having a second through-hole aligned with one of the through-hole and the cutout of the detection gear in the first direction in a case where the detection gear is at the first position.

15. The toner cartridge according to claim 14, further comprising a frame extending from an outer surface of another end portion of the casing in the second direction, the frame including a third through-hole aligned with the second through-hole in the first direction.

16. The toner cartridge according to claim 15, wherein, in the case where the detection gear is at the first position, the one of the through-hole and the cutout of the detection gear is positioned farther away from the auger than the outer surface of the another end portion of the casing in the second direction is positioned from the auger in the second direction, and wherein, in a case where the detection gear is at the second position, an outer surface of a portion of the detection gear different from the one of the through-hole and the cutout is positioned farther away from the auger than the outer surface of the another end portion of the casing in the second direction is positioned from the auger in the second direction.

17. The toner cartridge according to claim 14, wherein the second through-hole is positioned farther away from the auger than the outer surface of the another end portion of the casing in the second direction is from the auger in the second direction.

18. The toner cartridge according to claim 13, wherein the detection gear has a portion different from the one of the through-hole and the cutout, wherein a first distance between an outer surface of the portion of the detection gear and the auger in the second direction is smaller than a second distance between the one of the through-hole and the cutout and the auger in the second direction in a case where the detection gear is at the first position, and wherein a third distance between the outer surface of the portion of the detection gear and the auger in the second direction is larger than a fourth distance between the one of the through-hole and the cutout and the auger in the second direction in a case where the detection gear is at the second position.

19. The toner cartridge according to claim 1, wherein the auger is configured to convey the toner from the first end portion toward the second end portion in the first direction to convey the toner toward the toner outlet.

20. A toner cartridge comprising:

a casing configured to accommodate toner therein, the casing having a first end portion and a second end portion opposite to each other in a first direction, the second end portion including a toner outlet including a through-hole in an outer surface of the casing of the toner cartridge, the toner outlet being configured to allow the toner in the casing to be discharged outside of the casing of the toner cartridge by passing the toner therethrough;

an auger rotatable about a first axis extending in the first direction, the auger being configured to convey the toner in the first direction;

an auger gear rotatable with the auger, the auger gear being positioned at the first end portion of the casing;

an agitator rotatable about a second axis extending in the first direction, the agitator being configured to convey the toner toward the auger;

an agitator gear rotatable with the agitator, the agitator gear being positioned at the first end portion of the casing; and a detection gear rotatable about a third axis extending in the first direction and positioned at the first end portion of the casing, the detection gear being positioned on an opposite side of the agitator gear from the auger gear in a second direction crossing the first direction, the detection gear comprising:

a main body centered on the third axis and having an outer peripheral surface facing radially outward and extending a first radial distance from the third axis; and a plurality of gear teeth provided at the main body, the gear teeth extending radially outward from the third axis a second radial distance that is smaller than the first radial distance.

* * * * *